US005353103A

United States Patent [19]

Okamoto et al.

[11] Patent Number: 5,353,103

[45] Date of Patent: Oct. 4, 1994

[54] IMAGE RECORDING APPARATUS WITH TONER CONCENTRATION DETECTING CIRCUIT

[75] Inventors: Yukio Okamoto; Toshihiko Nakazawa, both of Hachioji, Japan

[73] Assignee: Konica Corporation, Tokyo, Japan

[21] Appl. No.: 86,163

[22] Filed: Jul. 1, 1993

[30] Foreign Application Priority Data

Jul. 24, 1992 [JP] Japan ..... 4-198669

[51] Int. Cl.[5] ..... G03G 21/00

[52] U.S. Cl. ..... 355/246; 355/203; 355/204; 355/208; 118/689

[58] Field of Search ..... 355/203, 204, 208, 246; 118/688-691; 222/DIG. 1

[56] References Cited

U.S. PATENT DOCUMENTS 4,435,677 3/1984 Thomas ..... 355/208 X
4,478,173 10/1984 Doehler ..... 118/688
4,515,292 5/1985 Koos, Jr. ..... 118/689 X
5,075,726 12/1991 Itaya et al. ..... 355/246
5,189,475 2/1993 Fournia et al. ..... 355/246

*Primary Examiner*—Matthew S. Smith
*Attorney, Agent, or Firm*—Frishauf, Holtz, Goodman & Woodward

[57] ABSTRACT

A toner concentration detecting circuit detects a toner concentration of a two-component developer composed of toner and a carrier by detecting a change of magnetic permeability of the two-component developer. The detecting circuit is used in a developing device of an image recording apparatus. The toner concentration detecting circuit includes a sensor for sensing a change of a magnetic permeability of the two-component developer, a waveform corrector, a counter connected to a control CPU and a gate signal generating circuit connected to the control CPU so that a gate signal is sent to the counter.

7 Claims, 7 Drawing Sheets

IMAGE RECORDING APPARATUS WITH TONER CONCENTRATION DETECTING CIRCUIT

BACKGROUND OF THE INVENTION

The present invention relates to an image recording apparatus such as an electrophotographic copier having a toner concentration detecting circuit by which a change in magnetic permeability of a two-component developer made of toner and carrier is detected so that toner concentration in the developer can be known.

In an image recording apparatus such as an electrophotographic copier and a facsimile, a document is irradiated by a light beam, and an image is recorded on a recording sheet by reflected light from the document, or by an electric signal of the image sent from the outside.

In this type of image recording apparatus, a visual image is formed using the two-component developer made of toner and carrier, and is recorded on the recording sheet. In the two-component developer, a toner mixing ratio to a predetermined carrier weight is 4 to 10 weight %. The toner is decreased when recording is conducted, and therefore, it affects density of a copied image. Accordingly, in order to obtain a recorded image with a constant density, it is necessary to detect toner concentration in the developer, to supply toner to the developer when the toner concentration is decreased, and to control the toner concentration so that it is within an appropriate range.

Conventionally, the following methods are widely known to detect toner concentration: a method in which a toner image density is optically detected according to a small piece having reference density; and a method in which a toner concentration detecting sensor including a coil is provided close to the developer, and magnetic permeability of the developer is measured by the sensor so that the toner concentration (toner mixing ratio) in the developer can be known. The method, by which magnetic permeability is measured, has the advantages that the magnetic permeability can be always measured, and it is not necessary to change copying processes. The detected toner concentration is compared with a toner concentration reference value, and the toner is supplied so that the toner concentration in the developer can be always maintained.

FIG. 6 is a block diagram showing circuits by which the toner concentration is detected from the magnetic permeability of the developer, and which are applied to a developing section of a conventional image recording apparatus. In the drawing, numerals 51Y, 51M, 51C, 51K are toner concentration detecting sensors which are provided in developing devices in which yellow (Y), magenta (M), cyan (C), black toners are respectively loaded, and by which toner concentration is detected according to the change of an oscillation frequency depending on the magnetic permeability of the developer. Numeral **52*a* is an analog multiplexer by which one of signals sent from the plurality of sensors 51Y to 51K is selected by a selection signal sent from a CPU 50, and sent to the next circuit, and numeral 53*b* is a waveform correction circuit in which a Schmitt circuit is used. Numeral 54*a* is a counter, for example, a 9-bit counter, which counts pulses in a predetermined time by a gate signal sent from a gate signal generating circuit 55*a*. Numeral 55*b* is a resonance circuit using a ceramic oscillation element. Numeral 58 is a D/A converter. Numeral 59 is a sample/hold circuit which samples and holds an analog value inputted by the sample/hold signal sent from the gate signal generation circuit 55*a*. Numeral 60 is a differential amplifier, and numeral 61 is an A/D converter accommodated in the CPU 50**.

Outputted values from sensors 51Y to 51K are increased when a frequency is increased as the toner concentration of the developer is increased. One of the outputs is selected by the analog multiplexer **52*a*, waveform-corrected through a waveform correction circuit 53*b*, and after that, the number of pulses in a predetermined time is counted by the counter 54*a*. The counted value (digital value) is converted into a voltage value by the D/A converter 58, and after that, the voltage value is held by the sample/hold circuit 59. The held voltage value is inputted into the differential amplifier 60 together with the voltage value into which a digital value outputted from the CPU 50 is converted by the D/A converter 58, wherein the digital value is outputted from the CPU 50 to correct deviation due to the kind of the developer or an intrinsic error of the developing device. After that, the voltage value is amplified by the differential amplifier 60 and inputted into CPU 50. The inputted value is converted into a digital value by A/D converter 61 in the CPU 50, and after that, it is compared with a reference value. A toner replenishing direction signal is outputted to a toner replenishing means 17** corresponding to the difference between the above two values, and the toner is replenished to the developer.

In the toner concentration detecting circuit of a conventional image recording apparatus as described above, sensitivity of a sensor, that is, a change of the oscillation frequency of the sensor to a change of toner concentration of the developer, is extremely low. The sensitivity is as follows: when a center frequency of the sensor is 200 KHz, the frequency increases by 0.8 KHz as the toner concentration increases by 1 wt %. That is, when a gate time is 10 ms, the frequency increases by 8 pulses with respect to a 1% increase of the toner concentration. Accordingly, a change of the toner concentration is 0.125% per pulse, so that a highly accurate circuit is necessary.

However, as described above, in the conventional toner concentration detecting circuit, the circuit is complicated; noises are caused and an error becomes large because A/D conversion is further carried out after D/A conversion; and the cost becomes high, which are problems.

Further, because many analog circuits are used in the detecting circuit, an error in the circuit becomes large when voltage of a power source or temperature is varied, or variations in parts are caused.

SUMMARY OF THE INVENTION

An object of the present invention is to provide an image recording apparatus with a toner concentration detecting circuit in which cost is low, and toner concentration can be always maintained within an appropriate range.

An embodiment to accomplish the object of the present invention is as follows: in an image recording apparatus with a toner concentration detecting circuit by which a change of magnetic permeability of a two-component developer made of toner and carrier is detected so that toner concentration of the developer can be detected, the image forming apparatus with a toner concentration detecting circuit comprises; a sensor by which a change of magnetic permeability of the developer is detected; a waveform corrector; a counter connected to a control CPU; and a gate signal generating circuit connected to the control CPU by which a gate signal is sent to the counter.

DETAILED DESCRIPTION OF THE PREFERRED EMBODIMENTS

Figure 2:
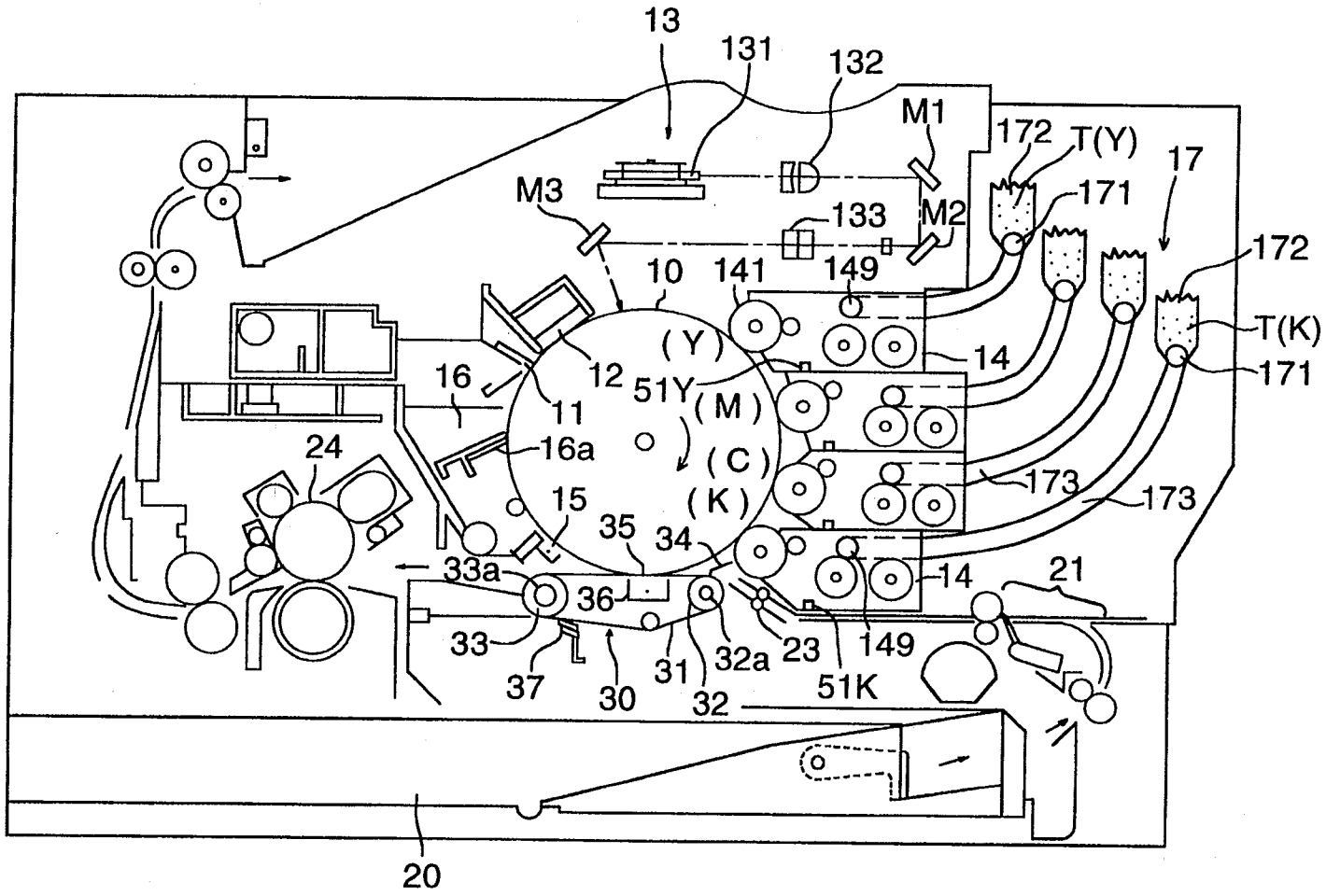
FIG. 2 is a schematic view showing a structure of an example of the image recording apparatus of the present invention.
Figure 7:
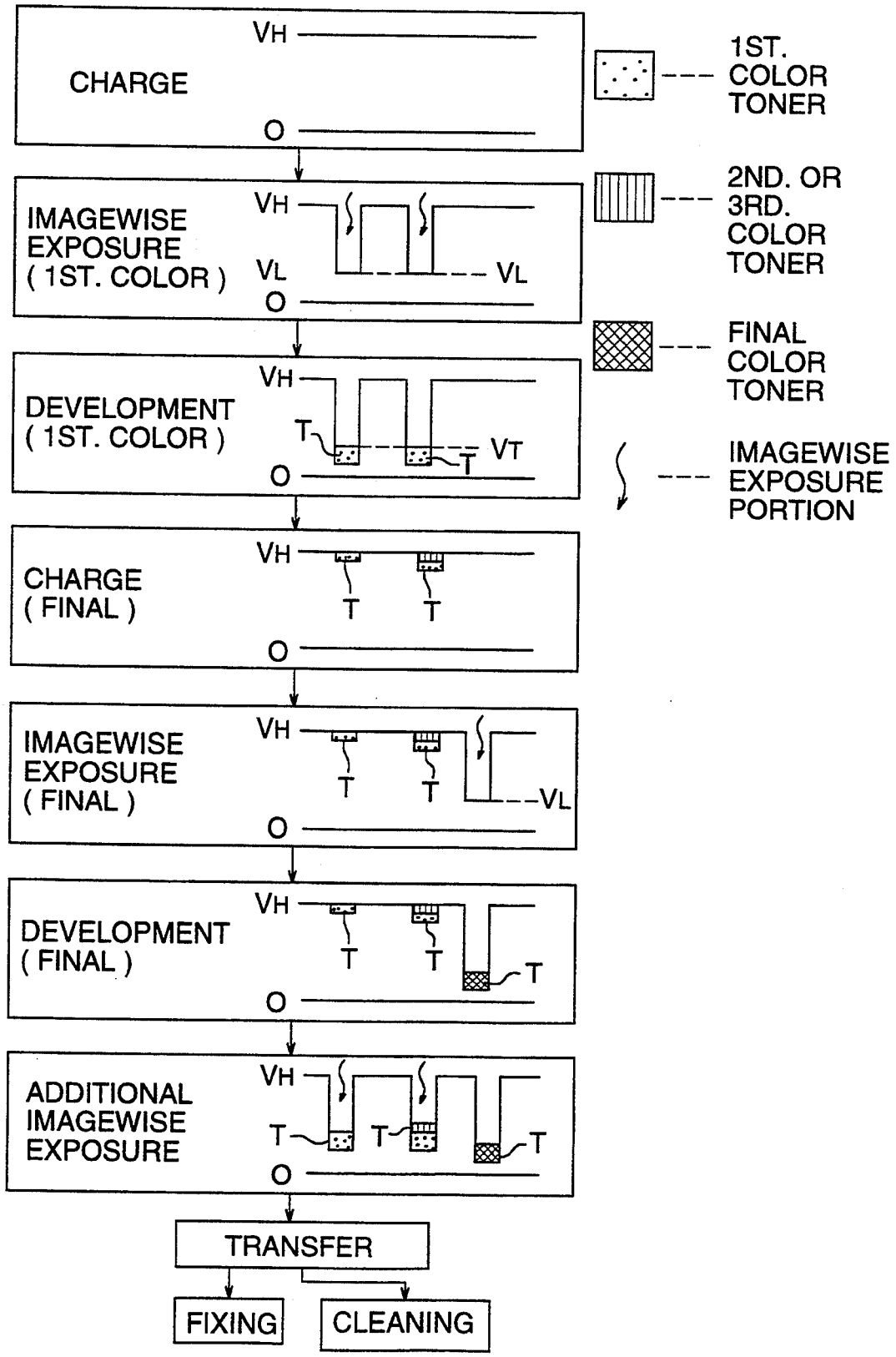
FIG. 7 is a flow chart showing a voltage change of an image carrier when a multi-color toner image is formed according to the example shown in FIG. 2.

FIG. 2 is a schematic view showing a structure of an example of an image recording apparatus of the present invention. FIG. 7 is a flow chart showing a voltage change of an image carrier when a multi-color toner image is formed according to the example. Referring to FIG. 2 and FIG. 7, a basic structure and operations of the example will be described as follows.

In FIG. 2, numeral 10 is a photoreceptor drum which is an image carrier. It is grounded, for example, by means of coating an OPC photoreceptor layer on the drum, and is rotated clockwise. Numeral 12 is a scorotron charger by which the peripheral surface of the photoreceptor drum 10 is uniformly charged with a negative electric potential of $V_H$ (−600 to −800 V) by a corona discharge using a grid, a potential of which is maintained at a predetermined potential $V_G$ (−550 to −850 V), and a corona discharge wire. Prior to charging by the scorotron charger 12, the peripheral surface of the photoreceptor drum is discharged when exposure is conducted by a pre-charging exposing means (PCL) 11 using a light emitting diode or an exposure lamp in order to eliminate any trace of the preceding printing operation on the photoreceptor drum.

After the photoreceptor drum 10 has been uniformly charged, imagewise exposure according to an image signal is carried out by a laser writing device 13 which is an imagewise exposure means. A latent image is formed on the photoreceptor drum 10 by the imagewise exposure when an image signal is inputted from a CPU into the laser writing device 13, or the image signal outputted from an image reading device is inputted into the laser writing device 13 after the image signal has been processed in an image signal processing section.

A light emitting source of the laser writing device 13 is a laser diode (not shown in the drawing). A laser beam emitted from the laser writing device 13 passes through a rotating polygonal mirror 131, an fθ lens 132, and the like. Its light path is bent by a plurality of reflection mirrors M1, M2, M3 for scanning, and a latent image is formed by rotation of the photoreceptor drum 10 (subsidiary scanning). In the example, exposure is conducted on an image section according to the image signal, and a reversal latent image is formed in which an absolute value of the electric potential on the image section is $V_L$ (−100 V to 0 V) as shown in FIG. 7.

Developing devices 14 in which developers composed of yellow (Y), magenta (M), cyan (C), and black (K) toners, which are negatively charged, and carrier are accommodated respectively, are provided around the photoreceptor drum 10. At first, the first color development is conducted by a developing sleeve 141 in which a magnet roller is accommodated, and which is rotated while holding the developer thereon. The developer is composed of: carrier in which ferrite is used as a core, with insulating resin coated around the core; and toner T in which polyester is used as the main material, and a pigment according to the color, a charge control agent, silica, and titanium oxide are added to the main material. A layer thickness of the developer is regulated to 300 to 800 μm on the developing sleeve 141 by a layer forming bar, and the developer is conveyed to a developing area.

A gap between the developing sleeve 141 and the photoreceptor drum 10 in the developing area is 0.4 to 1.0 mm which is larger than the layer thickness of the developer. An AC bias voltage of $V_{AC}$(1.5 to 3.0 $kV_{P-P}$) and a DC bias voltage of $V_{DC}$ (−500 to −700 V) are superimposed and impressed upon the gap. $V_{DC}$, $V_H$, and a charging potential of toner T have the same polarity (negative), and therefore, the toner T which separates from the carrier, does not adhere to a $V_H$ portion having an absolute value of potential higher than $V_{DC}$, but adheres to a $V_L$ portion having an absolute value of potential lower than $V_{DC}$ according to the potential difference therebetween, and development (reversal development) is carried out.

After the first color development has been completed, the image forming operation enters into the second color image forming process, the image forming surface is uniformly charged again by the scorotron charger 12, and a latent image according to the second color image data is formed by an imagewise exposure means 13. Charge elimination which has been conducted in the first color image forming process by the pre-charging exposure means 11, is not carried out this time because the toner T adhered to the first color image portion scatters when the potential surrounding the image portion is suddenly lowered.

In a photoreceptor having a potential of $V_H$ covering the entire peripheral surface of the photoreceptor drum 10, the latent image is formed in the same way as that of the first color, and developed on portions on which the first color image does not exist. When imagewise exposure and development are conducted again on a portion on which the first color image exists, a latent image having a potential of $V_T$ is formed by light insulation by the toner adhered to the first color image portion and the electric charge of toner itself, and developed corresponding to the potential difference between $V_{DC}$ and $V_T$. When the first color development is conducted on the latent image having a potential of $V_L$ on a portion on which the second color image is superimposed on the first color image, balance between the first color image and the second color image is lost. Therefore, sometimes, the first color exposure amount is decreased to the amount corresponding to an intermediate potential which is obtained by the following formula.

$$V_H > V_M (-100 \text{ to } -300) > V_L$$

The same image forming processes as that of the second color image are conducted on the third color and the fourth color images, and a four color toner image is formed on the peripheral surface of the photoreceptor drum 10.

A recording sheet P having been conveyed from a sheet feeding cassette 20 in timed relation with the toner image on the photoreceptor drum 10 by a sheet feed mechanism 21 and a timing roller 23 is fed to a transferring area by a transferring belt device 30 around which a transferring belt 31, which is a conveyance member, is stretched and a multicolor image on the peripheral surface of the photoreceptor drum 10 is collectively transferred onto the recording sheet P.

A bias voltage of about 2 kV is impressed upon a rotation shaft 32*a* of a holding roller 32 which is provided upstream of a holding roller 33, around both of which the transferring belt 31 is stretched, just before the leading edge of the recording sheet P arrives at the holding roller 32 from a high voltage power source not shown in the drawings. A conductive brush 34 is provided to a portion of the rotation shaft 32*a*, with which the recording sheet P is contacted through the transferring belt 31, as a charge applying means to the recording sheet P under the grounded condition through a current detecting circuit, which will be described later. The conveyed recording sheet P enters between the brush 34 and the transferring belt 31, an electric charge is given from the brush 34 to the recording sheet P for uniform charging, and thereby, the attractive force is generated between the recording sheet P and the transferring belt 31. Therefore, the recording sheet P is attracted and conveyed by the transferring belt 31. Thereby, the recording sheet P enters a nip portion (transferring area) 35 which is formed by the photoreceptor drum 10 and the transferring belt 31. A bias voltage of about 6 kV is impressed upon a transfer device 36, which is a corona discharger, or a bias roller, instead of the discharger, from the rear surface of the transferring belt 31 through a constant current control circuit from a high voltage power source not shown in the drawings, and a transferring electric field is formed on the recording sheet P. Therefore, the multi-color toner image is collectively transferred onto the recording sheet P.

The recording sheet P, which is separated from the photoreceptor drum 10 and has a multi-color toner image thereon, is discharged by AC corona discharge by a discharger 15, the position of which is changed, using a shaft 33*a* of the holding roller 33, around which the transferring belt 31 is wound, as an opposing electrode, wherein the holding roller 33 is provided on the downstream side of the holding roller 32. After that, or while being discharged by AC corona discharge, the recording sheet P is separated from the transferring belt 31. Numeral 37 is a cleaning blade, and toner adhered to the rotating transferring belt 31 is removed by the cleaning blade 37. During the multi-color toner image formation, the holding roller 32 is rotated clockwise, and is rotated around the shaft 33*a* of the holding roller 33, which is provided on the downstream side of the holding roller 32, as a rotation center, and the transferring belt 31 of the transferring belt device 30 is separated from the photoreceptor drum 10.

The recording sheet P which holds the multi-color image thereon and is separated from the transferring belt device 30, is conveyed to a fixing device 24 which is composed of two pressing rollers, wherein a heater is accommodated inside at least one roller or provided at an outside portion close to the roller. The toner adhered to the recording sheet P is fused when the recording sheet is heated and pressed between two pressing rollers, and is fixed onto the recording sheet P. After that, the toner is delivered to the outside of the apparatus.

On the other hand, toner remaining on the peripheral surface of the photoreceptor drum 10 after transfer, is electrically discharged by a discharger 15 using the AC corona discharger, and after that, conveyed to a cleaning device 16 which is a cleaning means. The toner is scraped down into the cleaning device 16 by a cleaning blade 16*a*, which is made of rubber and contacted with the photoreceptor, delivered by a screw, and after that, the toner is collected into a collection box.

After the photoreceptor drum 10, from which the remaining toner is removed by the cleaning device 16, is exposed by the pre-charging exposure means 11, it is uniformly charged by the scorotron charger 12, and enters the next image forming cycle. The cleaning blade 16*a* is separated from the photoreceptor surface during the multi-color image formation, and the AC discharge by the discharger 15 is turned OFF.

Numeral 17 in FIG. 2 is a toner replenishing means by which toners T of yellow (Y), magenta (M), cyan (C), black (K) are respectively replenished to developing devices 14, and is composed of: toner hoppers 172 in which color toners are respectively stored; toner replenishing rollers 171 which are rotated by control of a CPU 50 which will be described later; and replenishing paths 173 which are connected with toner replenishing inlets 149 of the developing devices 14.

Figure 3:
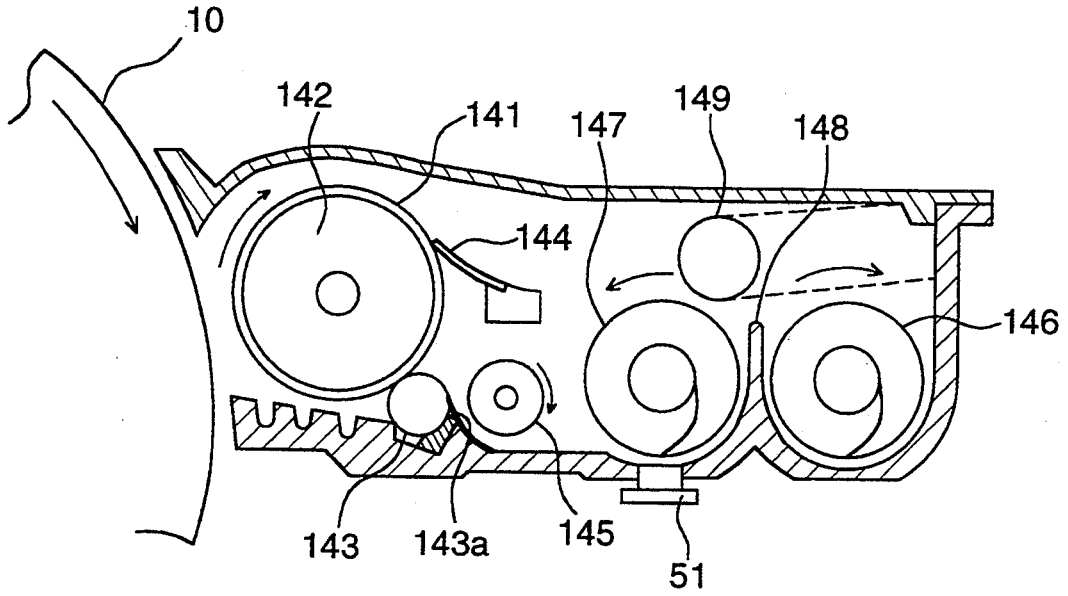
FIG. 3 is a sectional view showing a structure of an example of a developing device shown in FIG. 2.

FIG. 3 is a sectional view showing an example of the developing device, shown in FIG. 2, in which two-component developer is contained. The following devices are accommodated inside the developing device: a developing sleeve 141 containing a magnet roller 142; a thin layer forming bar 143 by which the layer thickness of the developer attracted by the developing sleeve 141 is regulated; a scraper 144, by which used developer is removed from the developing sleeve 141; a supplying roller 145 by which the developer is supplied to the developing sleeve 141; and a pair of stirring screws 146 and 147 by which toner and carrier of the developer are mixed together.

Toner T replenished from the toner replenishing device 17 by a toner replenishing roller 171 rotated by the control of the CPU, which will be described later, is processed as follows: the toner T is dropped onto one end of the stirring screw 147 from the toner replenishing inlet 149, and conveyed in the direction perpendicular to the surface of the drawing; the toner T arrives at an end portion of a partition wall 148, is moved to the end portion of the other stirring screw 146, and conveyed in the opposed direction; and the toner T is uniformly mixed in the developer accommodated in the developing device in the foregoing processes, and the developer in which a predetermined toner component is contained is obtained.

Next, the developer is conveyed on the peripheral surface of the developing sleeve 141 along a PET sheet 143*a*, which is contacted with the thin layer forming bar 143 with pressure, by the frictional force of the peripheral surface of the supplying roller 145; the developer is held by the magnetic force of the magnet roller 142; further, the layer thickness of the developer is formed into a predetermined thin layer by the contact action of the thin layer forming bar 143; and the developer is conveyed to the developing area on the photoreceptor drum 10.

The developer, in which the toner component has been consumed when the toner image was formed on the development area on the photoreceptor drum 10, is conveyed when the development sleeve 141 is rotated clockwise; the developer is removed from the peripheral surface of the developing sleeve 141 by the scraper 144 which is contacted with the peripheral surface of the developing sleeve 141 with pressure; the developer is dropped again near the supplying roller 145, mixed with new toner, and fed again to the developing sleeve 141.

The sensor 51, which detects the toner concentration by the change of magnetic permeability, is provided under the stirring screw 147 by a distance of 0 to 1 mm in the development unit 14, wherein the sensor 51 is faced upward.

Figure 4:
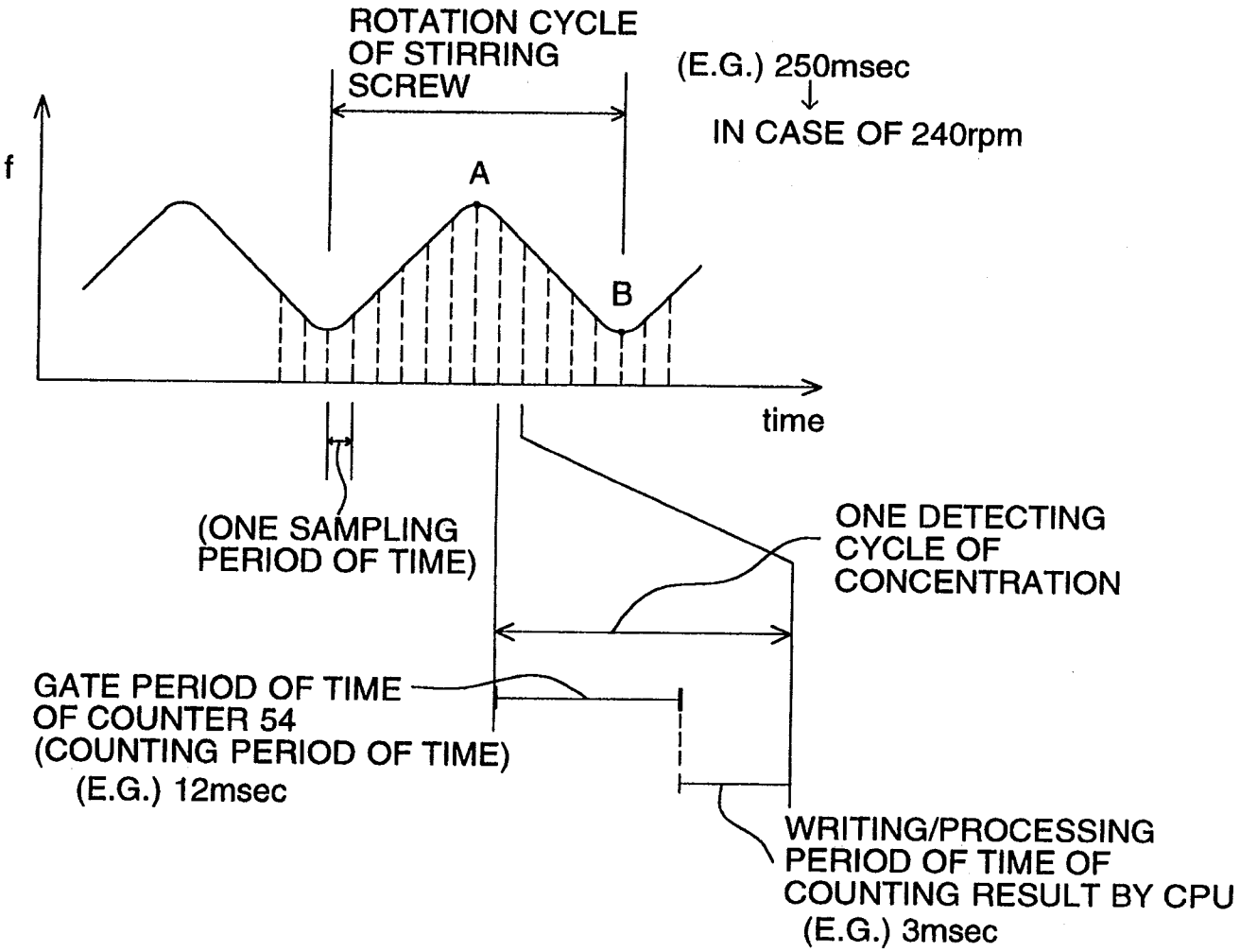
FIG. 4 is an illustration showing an output condition in toner concentration detection.

When the sensor is provided in the aforementioned position, an output of the sensor 51 is changed according to the movement of the stirring screw 147 provided above the sensor 51 as shown by a curve in FIG. 4. Point A on the curve shows an output of the sensor 51 when the thread ridge of the stirring screw 147 is positioned just above the sensor 51, and point B shows the output of the sensor 51 when the thread groove of the stirring screw 147 is positioned just above the sensor 51. The stirring screw 147 in the example is rotated at the rotational speed of 240 rpm, and therefore, the period of rotation of the stirring screw 147 is 250 msec. The CPU detects the toner concentration every 15 msec. In the interval of 15 msec, 12 msec is for a counting period, and 3 msec is for a data reading period. Such detection is repeated, and the toner concentration detection is carried out at point B. For a period of time (300 msec) longer than that of one rotation of the stirring screw 147 (250 msec), toner concentration detection sampling is repeated every 15 msec, and processed in this period of time. A series of the aforementioned controls is carried out by the CPU, and is processed inside the CPU.

Figure 1:
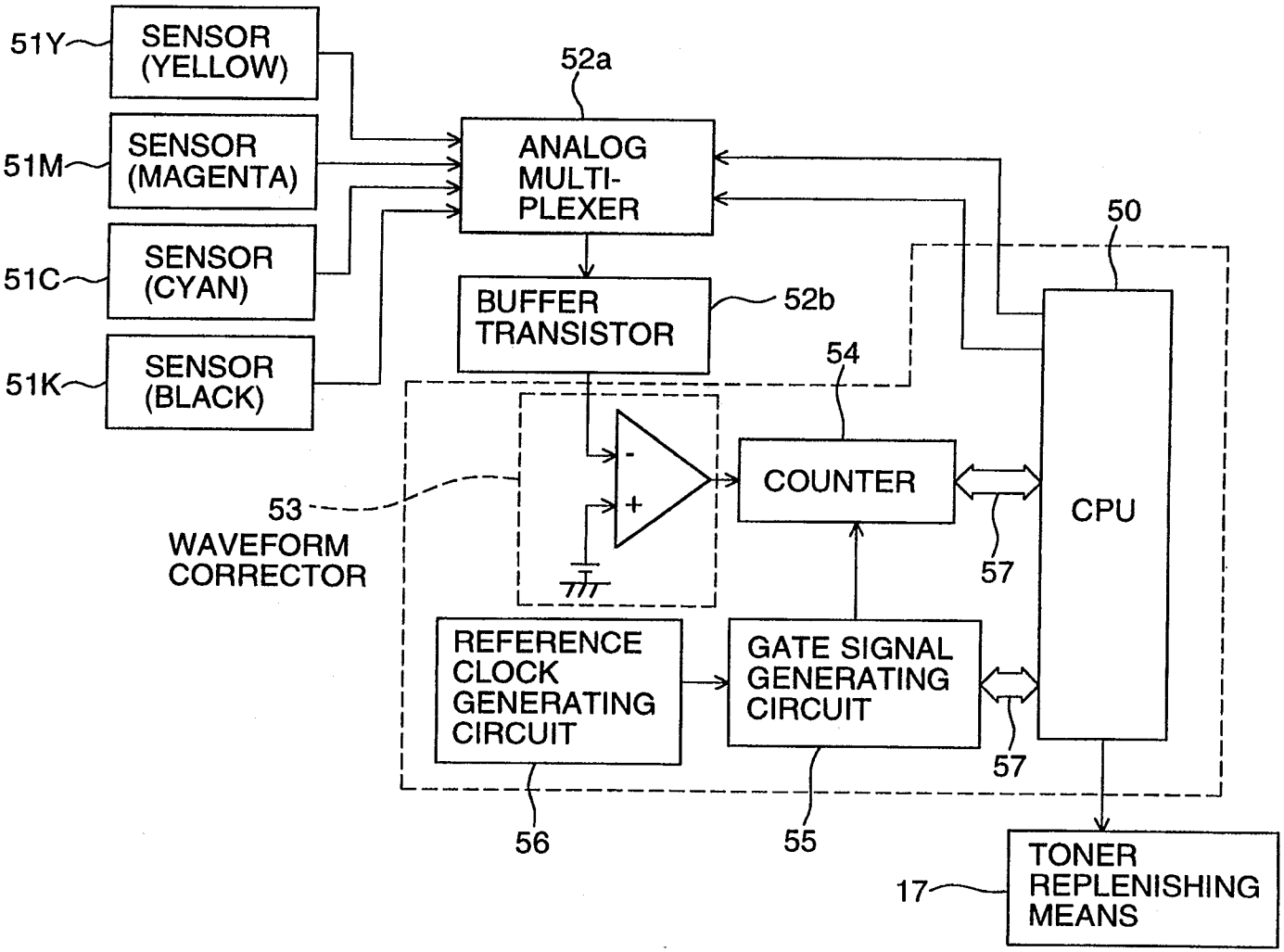
FIG. 1 is a block diagram showing an example of the toner concentration detecting circuit of an image recording apparatus of the present invention.
Figure 6:
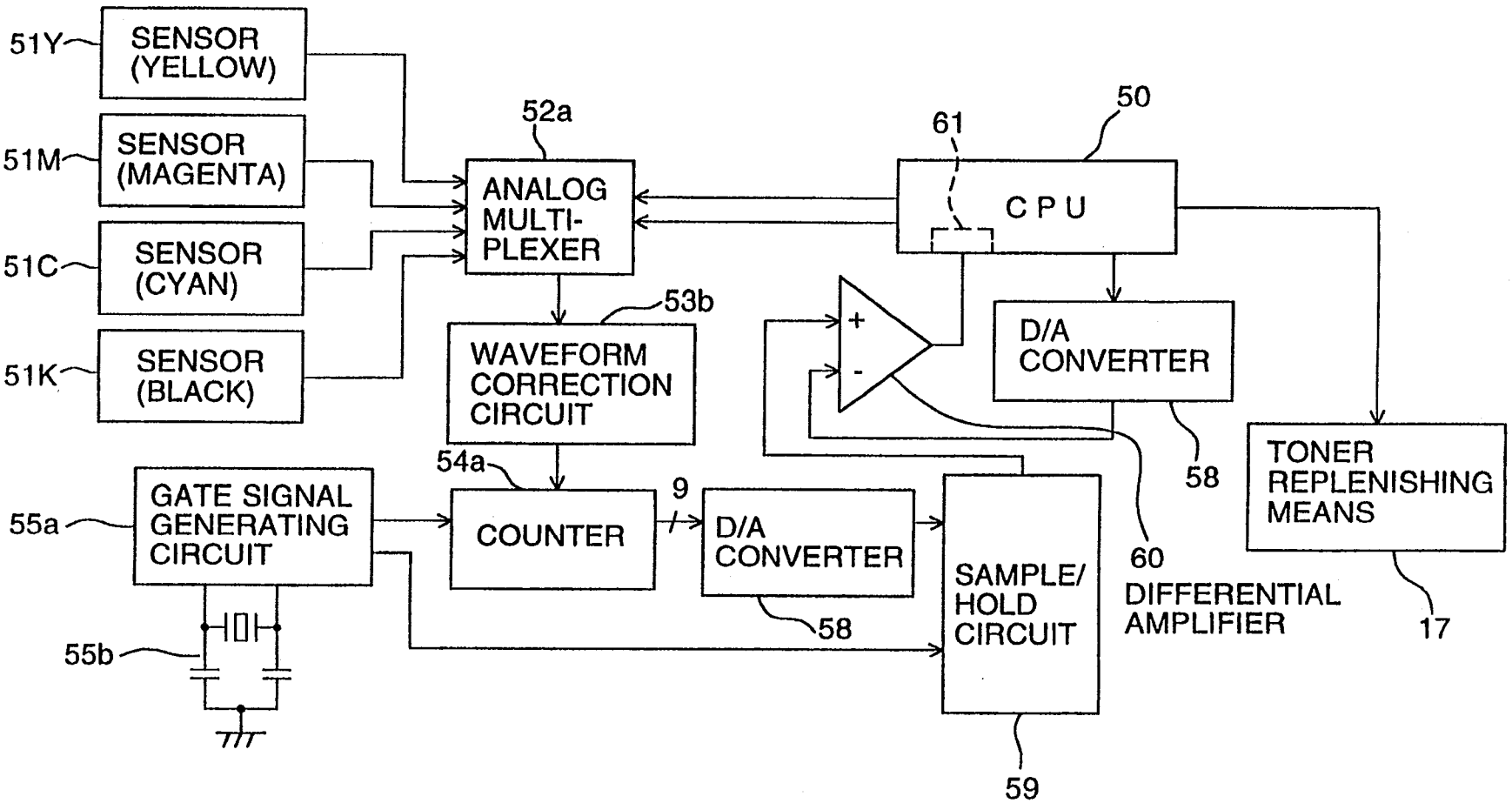
FIG. 6 (Prior Art)
FIG. 6 is a block diagram showing an example of a conventional toner concentration detecting circuit.

FIG. 1 is a block diagram showing an example of a toner concentration detecting circuit of the image recording apparatus of the present invention. The same parts as those of the conventional toner concentration detecting circuit as shown in FIG. 6 are denoted by the same symbols and numerals, and the detailed description is omitted. In FIG. 1, numeral **52*b* is a buffer transistor, numeral 53 is a waveform corrector composed of a comparator, numeral 54 is a 16-bit counter, numeral 55 is a gate signal generating circuit, into which a clock pulse outputted from a reference clock generating circuit 56 composed of a quartz oscillator is inputted, and which is composed of a 16-bit counter, and the counter 54 and the gate signal generating circuit 55 are connected with the CPU 50 through a bus line 57**.

One of the outputs from sensors 51Y to 51K is selected by an analog multiplexer **52*a*, and inputted into the waveform corrector 53 through a buffer transistor 52*b*. The waveform of the inputted signal is corrected to a rectangular waveform by the waveform corrector 53, and the signal is inputted into the counter 54. In the counter 54, the number of pulses is counted in a constant period of time, for example, 100 msec, by a gate signal sent from the gate signal generating circuit 55. The counted number (a digital value) is inputted into the CPU 50 at once. The inputted value is compared with the reference value stored in a memory of the CPU 50, and a toner replenishing direction signal is outputted to the toner replenishing means 17 according to the result in the foregoing comparison. The foregoing processes are repeated in sequence of Y, M, C, and K according to the signal selected by the analog multiplexer 52*a*. Due to the foregoing, toner is respectively replenished to developer in each developing device 14**.

Figure 5:
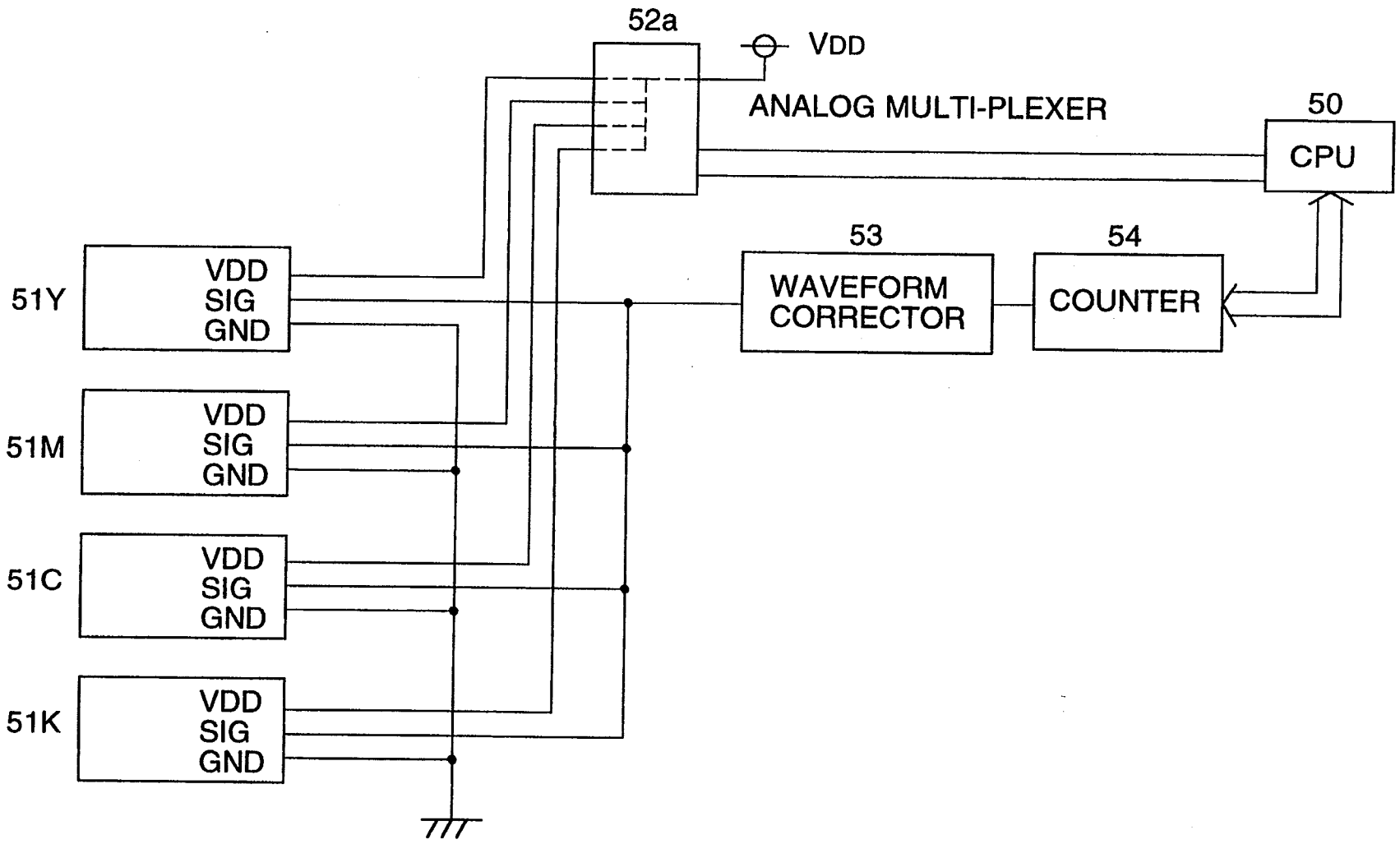
FIG. 5 is a circuit diagram of an example in which output signals of sensors are changed over.

In the toner concentration detecting circuit shown in FIG. 1, the buffer transistor **52*b* may be omitted, or the buffer transistors may be respectively accommodated in output sections of sensors 51Y, 51M, 51C, and 51K. As a switching method, by which signals of sensors 51Y, 51M, 51C and 51K are respectively switched, the circuit shown in FIG. 5 may be used. In FIG. 5, the buffer transistor is accommodated in the sensor, and $V_{DD}$ is a power supply for the sensor, for example, DC+5 V. SIG is an output signal of the sensor, and it is outputted in the form of an almost sinusoidal wave of 200 kHz. GND is a ground for the sensor. As a method by which signals of sensors 51Y to 51K are switched, the power supply $V_{DD}$, by which the voltage is impressed upon sensors 51Y to 51K, is switched by an analog multiplexer 52*a***, and in this case, only one sensor is always oscillated. Accordingly, the interference of signals between sensors can be prevented, which is advantageous.

When a step-up circuit, by which the frequency is stepped up, is inserted between the waveform corrector 53 and the counter 54 so that the apparent frequency is increased, an amount of the toner concentration changed per one increased pulse can be reduced, so that the detecting accuracy can be improved.

In the image recording apparatus, since the toner concentration detecting circuit is structured as described above, the number of analog circuits can be greatly reduced, and the structure can be simple. Accordingly, noises can be prevented from entraining on the circuit, so that the detecting accuracy can be improved, and the system design of the control circuit can be easily performed.

Further, recently, since many digital controlled image recording apparatuses are used as described in the example, the following advantage can be obtained: cost is easily lowered when digital circuits in the toner concentration detecting circuit are integrated in an integrated circuit together with digital circuits in the apparatus main body.

Further, the following advantage can be obtained: since the gate signal generating means is directly connected with the CPU by the bus line, when a signal to correct the deviations caused by the kind of developer or errors inherent to the developing device, is sent from the CPU to the gate signal generating means, and the gate time is changed, the errors can be easily corrected.

What is claimed is:

1. A toner concentration detecting circuit for a two-component developer including a toner and a carrier in a developing device of an image recording apparatus, said toner concentration detecting circuit comprising:

(a) a sensor provided in said developing device, for sensing a change of a magnetic permeability of the developer and for outputting an oscillating frequency based on a sensed change of magnetic permeability;

(b) a waveform corrector for generating a square pulse wave based on said oscillating frequency;

(c) a gate signal generating circuit for generating a gate signal;

(d) a counter for counting a number of pulses in said square pulse wave within a first predetermined period of time according to said gate signal, said counter outputting a toner concentration value that is representative of said number of pulses counted by said counter;

(e) a central processing unit including means for detecting a plurality of said toner concentration values within a second predetermined period of time, and means for comparing one of said toner concentration values with a reference value pre-stored in said central processing unit, said central processing unit generating a toner replenishment command signal, said toner replenishment command signal being representative of the comparison by said central processing unit; and (f) toner replenishing means for replenishing a toner in said developing device based on said toner replenishment command signal.

2. The toner concentration detecting circuit of claim 1, wherein said developing device comprises a screw for stirring and conveying the developer toward a developing area, and wherein a detecting surface of said sensor is disposed below said screw.

3. The toner concentration detecting circuit of claim 2, wherein a distance between a lower portion of said screw and said detecting surface of said sensor is less than 1 mm.

4. The toner concentration detecting circuit of claim 2, wherein said second predetermined period of time is longer than a period for one rotation of said screw.

5. The toner concentration detecting circuit of claim 2, wherein said central processing unit selects said one of said toner concentration values in accordance with a relation between a position of a thread of said screw and said detecting surface of said sensor so as to generate said toner replenishment command signal.

6. The toner concentration detecting circuit of claim 1, wherein said central processing unit controls said gate signal generating circuit so as to change said first predetermined period of time.

7. An image forming apparatus for a two-component developer including a toner and a carrier, the image forming apparatus comprising:

(a) a plurality of developing devices;

(b) a sensor provided in each of said developing devices, for sensing a change of a magnetic permeability of the developer and for outputting an oscillating frequency based on a sensed change of magnetic permeability;

(c) a waveform corrector for generating a square pulse wave based on said oscillating frequency;

(d) a gate signal generating circuit for generating a gate signal;

(e) a counter for counting a number of pulses in said square pulse wave within a first predetermined period of time according to said gate signal, said counter outputting a toner concentration value that is representative of said number of pulses counted by said counter;

(f) a central processing unit including means for detecting a plurality of said toner concentration values within a second predetermined period of time, and means in said central processing unit for comparing one of said toner concentration values with a reference value prestored in said central processing unit, said central processing unit generating a toner replenishment command signal, said command signal being representative of the comparison by said central processing unit; and (g) toner replenishing means for replenishing a toner in at least one of said developing devices based on said toner replenishment command signal.

* * * * *